US007128500B2

(12) United States Patent
Meyer

(10) Patent No.: US 7,128,500 B2
(45) Date of Patent: Oct. 31, 2006

(54) CORNER CONNECTION FOR TEMPORARY SHORING

(76) Inventor: John H. Meyer, 9323 Fourth St., Lanham, MD (US) 20706

( * ) Notice: Subject to any disclaimer, the term of this patent is extended or adjusted under 35 U.S.C. 154(b) by 0 days.

(21) Appl. No.: 10/864,504

(22) Filed: Jun. 10, 2004

(65) Prior Publication Data

US 2004/0223814 A1 Nov. 11, 2004

Related U.S. Application Data

(63) Continuation of application No. 10/166,635, filed on Jun. 12, 2002, which is a continuation of application No. 09/568,856, filed on May 11, 2000, now Pat. No. 6,416,259.

(51) Int. Cl.
*E02D 17/04* (2006.01)

(52) U.S. Cl. ..... 405/283; 405/282; 405/272

(58) Field of Classification Search ..... 405/283, 405/282, 272; 403/335, 337; 256/65
See application file for complete search history.

(56) References Cited

U.S. PATENT DOCUMENTS

| | | | | |
|---|---|---|---|---|
| 1,225,431 A | | 5/1917 | Gelbart | |
| 2,690,326 A | | 9/1954 | Kranick | |
| 2,888,818 A | * | 6/1959 | Leuthesser | 52/264 |
| 2,956,409 A | | 10/1960 | Wicke | |
| 3,159,978 A | | 12/1964 | De Lillo | |
| 3,420,065 A | | 1/1969 | Holl | |
| 3,496,727 A | * | 2/1970 | Weese et al. | 405/283 |
| 3,584,465 A | | 6/1971 | Holl | |
| 3,710,578 A | * | 1/1973 | Inoue | 405/282 |
| 3,750,409 A | | 8/1973 | Orfei | |
| 3,992,887 A | | 11/1976 | Fisher | |
| 4,208,038 A | * | 6/1980 | Reid | 256/67 |
| 4,398,840 A | * | 8/1983 | French | 403/98 |
| 4,453,863 A | | 6/1984 | Sutton et al. | |
| 4,682,914 A | | 7/1987 | Aihara et al. | |
| 4,685,837 A | | 8/1987 | Cicanese | |
| 4,850,747 A | | 7/1989 | Morelli | |

(Continued)

FOREIGN PATENT DOCUMENTS

GB 2166774 5/1986

*Primary Examiner*—Sunil Singh
(74) *Attorney, Agent, or Firm*—Diederiks & Whitelaw, PLC

(57) ABSTRACT

A connection arrangement for temporary shoring in an excavation site is used to secure I-beams together at corners within the excavation site. Typically, four I-beams are connected together to form a rectangular frame that is suspended within the excavation for bracing the shoring walls thereof. However, any polygonal shape may be used. The connection arrangement includes mating socket or connecting members which are placed over the ends of I-beams to be fastened together. One of the connecting members includes an outwardly extended tab while the other includes a pair of outwardly extended tabs. The first outwardly extending tab fits between the two extending tabs of the corresponding connecting member. All of the tabs are provided with apertures which are placed in alignment when the connection is made so that a bolt or pin can be passed through the apertures to secure adjacent connecting members together. Each connecting member also includes a large eyelet for receiving a chain or other elongated supporting member which is typically used to suspend the resulting I-beam frame at a desired height within the shoring wall. Alternative embodiments provide for a secondary bar attached to the connectors to provide additional support. Also numerous beam/connector arrangements may be provided at different heights within a single excavation site. Such an arrangements provide much greater support for the side walls of the excavation site.

7 Claims, 4 Drawing Sheets

U.S. PATENT DOCUMENTS 4,993,880 A 2/1991 Collins
5,073,066 A 12/1991 Richland
5,154,541 A 10/1992 Boren et al.
5,214,899 A 6/1993 Beeche et al.
5,232,313 A 8/1993 Jennings et al.
5,234,188 A 8/1993 McSwain
5,593,143 A * 1/1997 Ferrarin ..... 256/68
5,683,074 A * 11/1997 Purvis et al. ..... 256/67
5,690,446 A 11/1997 Poissant et al.
5,711,131 A 1/1998 Thomas
5,741,091 A 4/1998 St. George et al.
5,966,890 A 10/1999 Inman
6,267,538 B1 7/2001 Caldwell
6,984,092 B1 * 1/2006 Meyer et al. ..... 405/283

* cited by examiner

CORNER CONNECTION FOR TEMPORARY SHORING

CROSS-REFERENCE TO RELATED APPLICATIONS

This application is a continuation of U.S. patent application Ser. No. 10/166,635 filed on Jun. 12, 2002 which is a continuation of U.S. patent application Ser. No. 09/568,856 filed on May 11, 2000 now U.S. Pat. No. 6,416,259.

BACKGROUND OF THE INVENTION

1. Field of the Invention

The present invention is generally directed to a system for temporarily shoring up an excavation site. More particularly the invention is directed to a corner connection used in a reinforcing arrangement that supports sheet piling in an excavation site.

2. Description of the Prior Art

In a typical excavation site, workers are exposed to numerous hazards. The most common hazard is having the walls of the excavation site cave in on the workers, thus causing serious injury. Often due to soil conditions and wetness, the sides of a construction site will simply collapse. Water is a particularly dangerous hazard because it is so heavy and can destroy shoring which has not been properly reinforced. Realizing this problem the government, at both the federal and state level, has set up specific requirements for all excavation sites to avoid the problem of cave-ins. For example the United States Department of Labor and, more specifically, the Occupational Safety and Health Administration (OSHA) requires that excavation sites be prepared with some type of shoring. Additionally many companies are now aware of the problems involved in a typical excavation site and have developed internal policies requiring shoring for any excavations they contract to have completed.

A good example of a typical excavation project would be found in replacing underground storage tanks for a gasoline station. Typically, in such an operation, sheet piling is pounded into the ground in a generally rectangular configuration around the work site. The piling has to be driven extremely deeply into the ground and arranged to provide sufficient support against potential cave-ins. Typically the sheet piling has to be driven so that half its total height remains underground after the excavation has been completed. Use of such large amounts of material is quite expensive. After the sheet piling has been installed, the workmen then remove the dirt and fill material from within the rectangular shoring. During the work of removing the old storage tanks and replacing them with new storage tanks the shoring provides protection to the workmen against potential cave-ins. Once the storage tank replacement operation has been completed the shoring can either be completely removed or simply cut down two a safe distance below ground and then left in place. Such a method of shoring an excavation site is extremely expensive.

Various solutions have been proposed in an attempt to cut down on the costs of shoring an excavation site. For example U.S. Pat. No. 5,154,541 discloses a modular earth support system. Specifically the patent teaches using panels which are adapted to be placed around an excavation site and interlocked with one another to form a generally rectangular shoring configuration. Once the panels are in place, reinforcing beams are placed behind the panels to ensure the weight and force of the dirt behind the panels does not cause the panels to fail. The main drawback of using such a system is that standard I-beams cannot be used. Rather, special beams which are cut exactly to size and additionally have a customized end configuration must be used. Such beams are particularly expensive, especially considering a large number of beams of varying sizes would have to be kept available for differently sized excavation sites.

Another proposed solution to reducing the high cost of shoring excavation sites can be found in U.S. Pat. No. 4,685,837. This patent proposes using panels as shoring members in an excavation site. The panels are reinforced by using laterally extending braces. The braces are connected to one another by a bracket or the braces maybe connected to each other by means of a connection in which one brace has a pair of tabs welded thereto with each tab having an aperture formed therein. The apertures align with a hole in a second brace and a pin is placed though the apertures to complete the connection. In either case there is no provision to adjust the length of the braces and connectors and they must be custom made for each different sized excavation site.

Numerous other proposed solutions are available including using wooden shoring which is a custom made to a particular excavation site. Such shoring is used only at the designated site and then disposed of. As a result this approach is prohibitively expensive. Also wooden shoring is not as durable as its metal counterparts. Often water along with regular wear and tear at the construction site can destroy the shoring during the construction job.

Based on the above, therefore there exists a need in the prior art of excavation shoring to provide a system wherein shoring can be provided at an excavation site in an inexpensive and reusable manner which does not suffer the disadvantages of the prior art discussed above. More specifically there exists in the in the art to provide a connector for interconnecting various beams used to reinforce shoring in a manner which enables the shoring to be adjusted easily or at least matched readily to the size of different excavation sites and additionally be reusable.

SUMMARY OF THE INVENTION

The present invention is directed to a corner connection for temporary shoring in an excavation site. Specifically, the corner connection is used to secure I-beams together at corners within the excavation site. Typically, four I-beams are connected together to form a rectangular frame that is suspended within the excavation for bracing the shoring walls thereof however, any polygonal shape may be used. The corner connection itself comprises mating socket or connecting members which are placed over the ends of I-beams to be fastened together.

One of the connecting members includes an outwardly extended tab while the other includes a pair of outwardly extended tabs. The first outwardly extending tab fits between the two extending tabs of the corresponding connecting member. All of the tabs are provided with apertures which are placed in alignment when the connection is made so that a bolt or pin can be passed through the apertures to secure the two connectors together. The socket members also include a large eyelet for receiving a chain or other elongated supporting member which is typically used to suspend the resulting I-beam frame at a desired height within the shoring wall. Alternative embodiments provide for a secondary bar attached to the connectors to provide additional support. Also numerous beam/connector arrangements may be provided at different heights within a single excavation site. Such an arrangements provide much greater support for the side walls of the excavation site.

Additional objects, features and advantages of the present invention will more readily be apparent from the following description of the preferred embodiment thereof, when taken in connection with the drawings wherein like reference numerals refer to correspond parts in the several views.

DETAILED DESCRIPTION OF THE PREFERRED EMBODIMENTS

Figure 1:
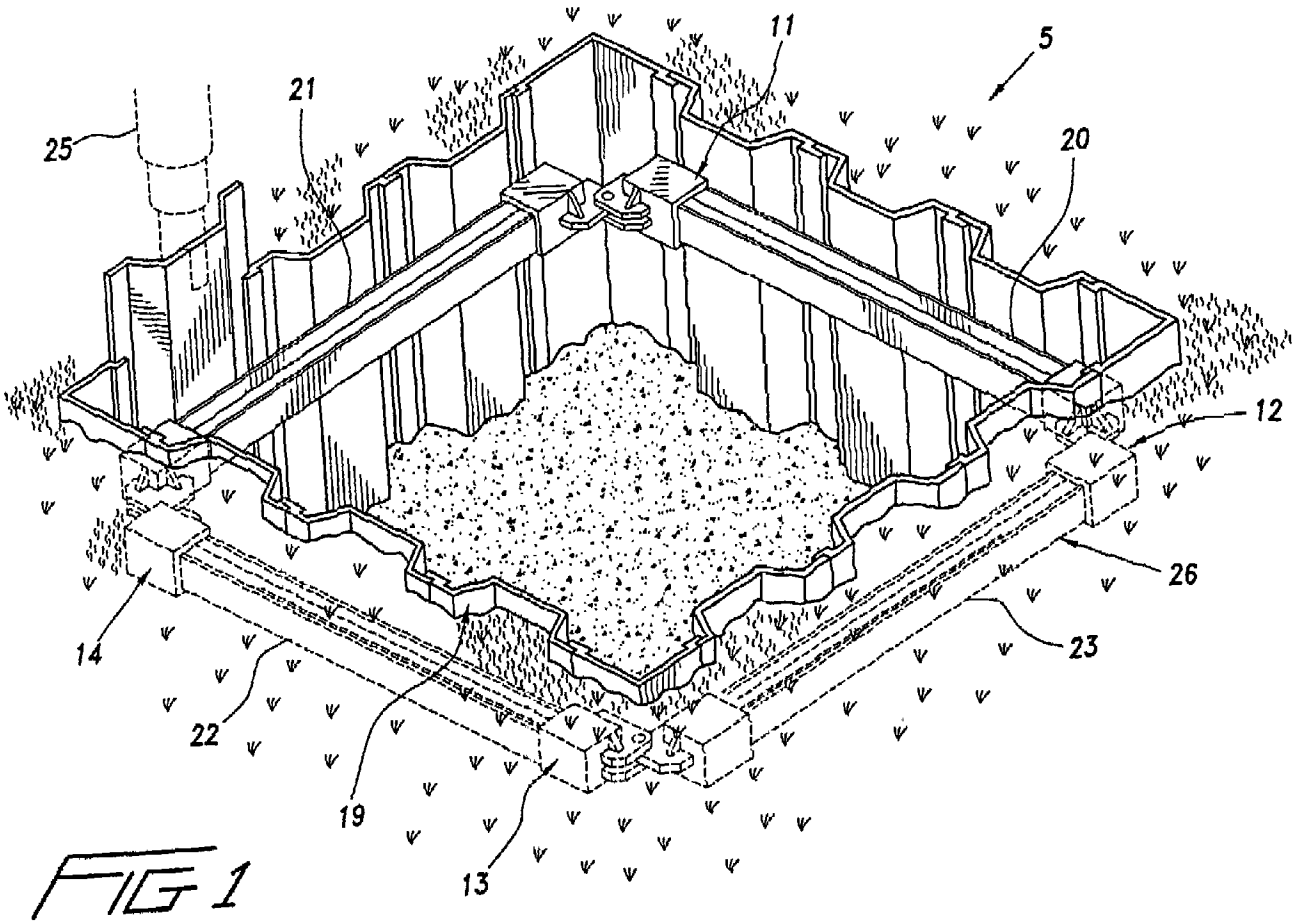
FIG. 1 is a prospective view of a corner connection and associated supporting beams for temporary shoring according to a first preferred embodiment of the invention as it would be seen in use in a typical excavation site.

Referring now to FIG. 1 there is shown a typical excavation site 5 incorporating corner connections 11–14 for temporary shoring 18 according to a preferred embodiment of the invention. The temporary shoring 18 actually comprises three major elements: interlocking sheet piling 19, reinforcing I-beams 20–23 and corner connections 11–14, each connection including two connectors for the I-beams 20–23. Interlocking sheet piling 19 is shown placed along the walls of the excavation site 5. Such interlocking sheet piling 19, which in the embodiment shown is formed by interconnecting two types of side wall panels and corner panels (not separately labeled), is usually driven into the ground prior to any digging. Typically a driving machine 25, which is essentially a pile driver, is used to drive each section of piling 19, which in the embodiment shown is formed by interconnecting two types of side panels and corner panels (not separately labeled), to a desired depth within the ground. As mentioned above, typically such sheet piling 19 was driven two to three times the depth of the excavated hole. In this preferred embodiment however, because of reinforcing structure 26 of the I-beams 20–23 and the corner connections 11–14, the sheet piling 19 need only be driven slightly deeper than the desired depth of the excavation hole. In either case the sheet piling 19 is driven into the ground one panel at a time each panel becoming an upstanding wall portion.

The panels of piling 19 have interlocking edges and thus can provide support for each other once they are in place. Also the panels are formed in an undulating pattern for added strength. Typically such panels are made of relatively thick and expensive sheet metal. It is important to note that using large quantities of such a sheet metal is extremely expensive. Furthermore, using prior shoring methods, the sheet metal was often left at the excavation site at the conclusion of the construction job. As will be discussed more fully below, with the subject method, the amount of sheet piling used is not only reduced, but less sheet piling is required initially because the sheet piling only has to extend as deep as the excavation hole.

The reinforcing structure 26 is provided behind the interlocking sheet piling 19. The reinforcing structure 26 includes the set of I-beams 20–23 which interact with the set of corner connections 11–14. Such a structure 26 is needed in order to prevent the sheet piling 19 from buckling under the weight of the earth surrounding the sheet piling 19. This is particularly true when the earth is wet or particularly loose. The corner connections 11–14 are designed to receive the ends of the I-beams 20–23 to form a rectangular structure. While a rectangular shape is shown here and is probably the most common configuration used it should be kept in mind that any polygonal configuration of three or more sides could be used and not depart from the spirit of the invention. The reinforcing structure 26 is then placed along the inside perimeter of the interlocking sheet piling 19. Under normal conditions the reinforcing structure 26 would simply be suspended by a chain or other mechanism (not shown) at a desired height within the excavation site 5. If however, the sheet piling 19 starts to buckle under the weight of wet earth it will immediately engage with the reinforcing structure 26. As pressure is placed on the I beams 20–23 and corner connections 11–14 they will only give a small distance before applying an enormous normal force which will stop the sheet piling 19 from any further buckling.

Figure 2:
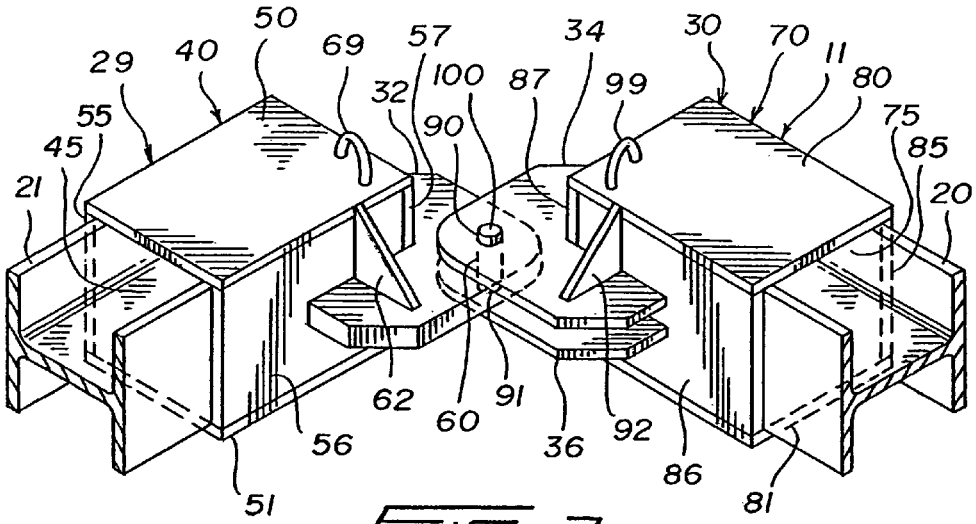
FIG. 2 is a perspective view of a corner connection including two corner connectors shown in their engaged condition connecting two reinforcing beams according to the first preferred embodiment of the invention.
Figure 3:
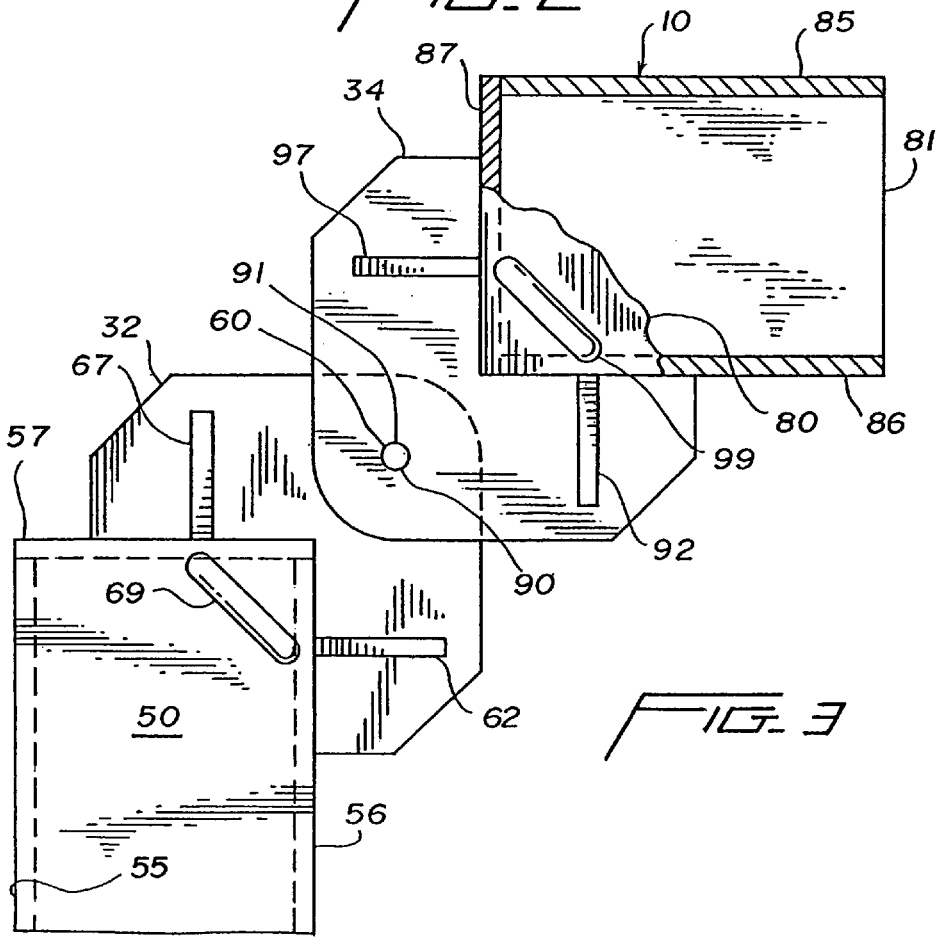
FIG. 3 is a plan view of a corner connection including two corner connectors shown in their engaged condition according to the first preferred embodiment of the invention.

Turning now to FIGS. 2 and 3 there is illustrated a close-up view of a corner connection 11 including two meeting connectors 29, 30 and the ends of two I-beams 20, 21. Each connector 29, 30 has a similar overall shape. However, one type of connector 29 has a single tab 32 while the other type of connector 30 has a double tab 34, 36. A single tab type connector 29 shown in FIG. 2 includes a box-like main body portion 40 having an opening 45 therein for receiving an I-beam 21. The box-like main body portion 40 comprises five major panels to form the open box shape. Opposing top 50 and bottom 51 panels are connected with opposing side panels 55, 56 to form the square or rectangular opening 45 designed to receive the I-beam 21. An end panel 57 also preferably square or rectangular in shape, closes off one end of the box type main body 40. These five pieces 50, 51, 55, 56, 57 are all made of heavy steel and are welded together. The end panel 57 and one of the side panels 56 has the single tab 32 welded thereto. The tab 32 is a flat plate like member which extends laterally from the box-like main body portion 40 of the connector 29 and has an aperture 60 formed therein. The tab 32 is made of a similar material as the panels of the box-like main body 40. The tab 32 is preferably welded to the side 56 and end 57 panels. While other methods may be used to attach the tab 32, it is important that the tab 32 be able to withstand the tremendous hydraulic pressures which may be transmitted by the sheet piling 19 as it starts to buckle.

Optionally a gusset 62 is formed between the side panel 56 and the tab 32 for added strength. As seen in FIG. 3, an additional gusset 67 may be formed between the tab 32 and the end panel 57. Preferably an eyelet 69 is formed on the top panel 50. The eyelet 69 is designed to receive a chain or other elongated supporting member (not shown) used to support the I-beams 20–23 and corner connections 11–14 at a desired height with the excavation site 5. The eyelet 69 is completely optional as the chain could simply be placed around one of the I-beams 20–23 to provide support.

A double tab type connector 30 shown in FIG. 2 includes a box-like main body portion 70 having an opening 75 therein for receiving an I-beam 20. The box-like main body portion 70 comprises five major panels to form the open box shape. Opposing top 80 and bottom 81 panels are connected with opposing side panels 85, 86 to form the square or rectangular opening 75 designed to receive the I-beam 20. An end panel 87 also preferably square or rectangular in shape closes off one end of the box type main body 70. These five pieces 80, 81, 85, 86, 87 are all made of heavy steel and are welded together. The end panel 87 and one of the side panels 86 has top and bottom tabs 34, 36 welded thereto. The tabs 34, 36 are flat members which extend laterally from the box-like main body portion 70 of the connector 30 and each have an aperture 90, 91 formed therein. The tabs 34, 36 are made of a similar material as the panels of the box-like main body 70. The tabs 34, 36 are preferably welded to the side 86 and end 87 panels. While other methods may be used to attach the tabs 34, 36 it is important that the tabs 34, 36 be able to withstand the tremendous hydraulic pressures which may be transmitted by the sheet piling 19 as it starts to buckle.

Optionally a gusset 92 is formed between the side panel 86 and the top tab 34 for added strength. Webs (not shown) may be formed between the two tabs 34, 36 in order to further increase their strength. As seen in FIG. 3 an additional gusset 97 may be formed between the top tab 34 and the end panel 87. Preferably an eyelet 99 is formed on the top panel 80. The eyelet 99 is designed to receive a chain or other elongated supporting member (not shown) used to support the I-beams 20–23 and corner connections 11–14 at a desired height with the excavation site 5. The eyelet 99 is completely optional as the chain could simply be placed around the I-beams 20–23 to provide support.

As can clearly be seen in FIG. 2, connectors 29, 30 may easily be joined together by placing the tab 32 of the single tab connector 29 within the two tabs 34, 36 of the double tab connector 30. Ideally, the single tab aperture 60 aligns with the apertures 90, 91 formed in each of the two tabs 34, 36 of the double tab connector 30. A securing bolt or pin 100 is placed through the aligned apertures 60, 90, 91 in order to pivotably secure the connectors 29, 30 together. The bolt or pin 100 will support all the forces transmitted between the two connected I-beams 29, 30 and therefore must be made of a particularly strong material such as hardened steel. Although shown here as I-beams, beams of different shapes could be used so long as the connector and beam have mating shapes. For example, round, L-shaped and U-shaped beams could be used, as could a beam of almost any cross section.

Figure 4:
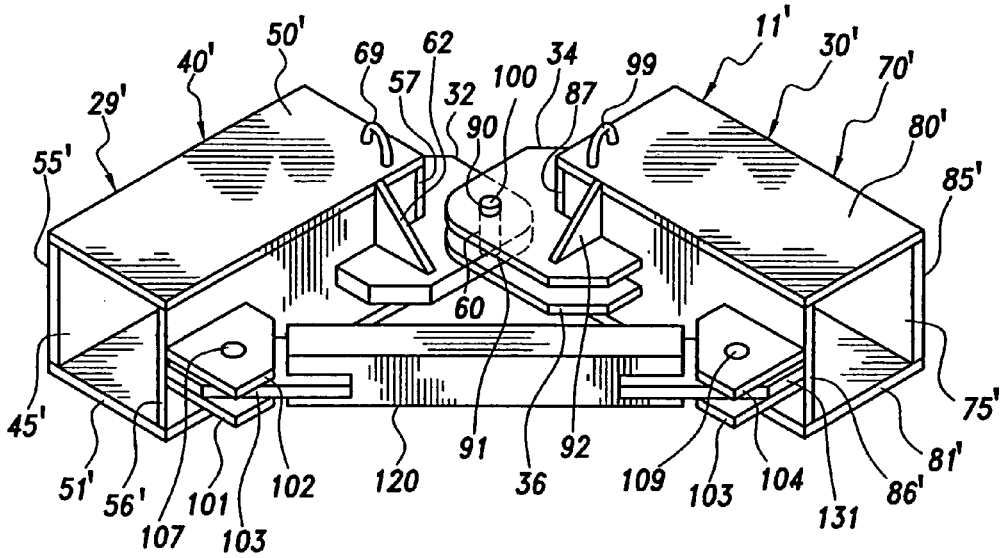
FIG. 4 is a prospective view of a corner connection including two corner connectors shown in their engaged condition according to a second preferred embodiment of the invention.
Figure 5:
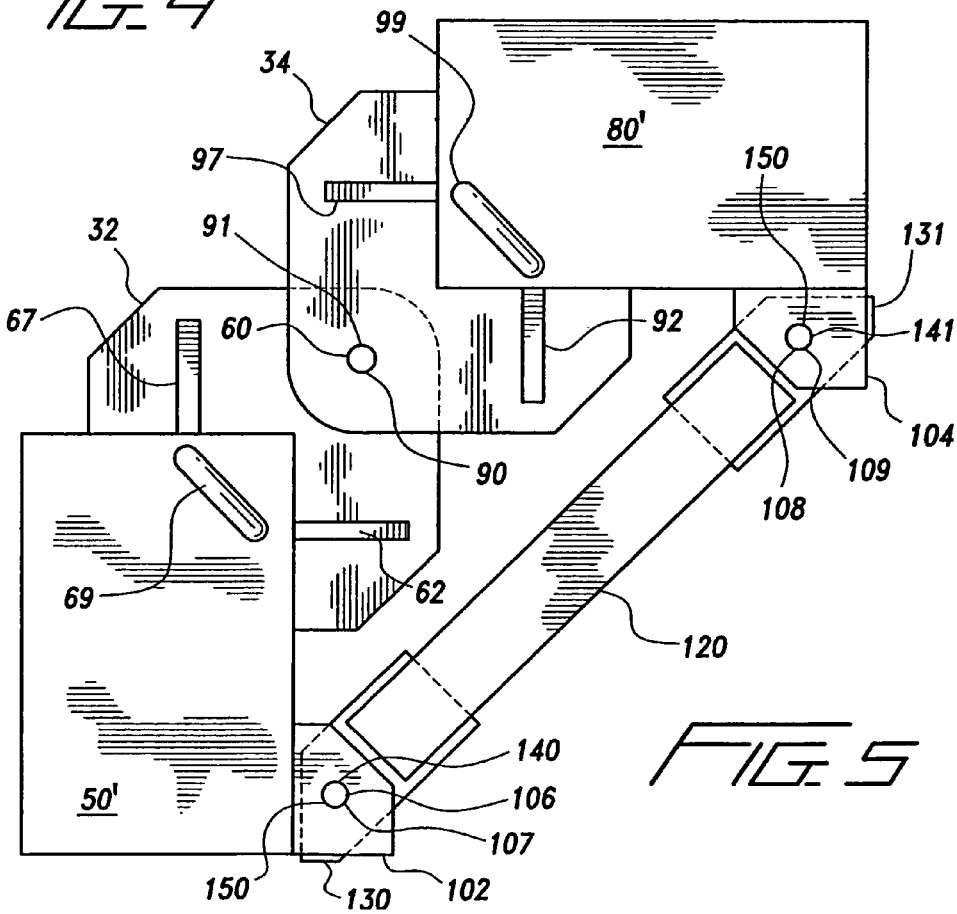
FIG. 5 is a plan view of a corner connection including two corner connectors shown in their engaged condition according to the second preferred embodiment of the invention.

Turning now to FIGS. 4 and 5, there is shown a second preferred embodiment of the invention. Specifically, the box like connectors 29, 30 of the first embodiment illustrated in FIGS. 2 and 3 now are shown with modifications to support an added reinforcing member. Since the connectors 29', 30' shown in FIGS. 4 and 5 are based on the connectors 29, 30 shown in FIGS. 2 and 3 only a discussion of the modifications will be provided here.

Essentially each box type connector 29', 30' has a box-like main body 40', 70' that has been lengthened along with its corresponding panels 50', 51', 55', 56', 80', 81', 85', 86' to provide room to support a pair of extra tabs 101, 102, 103, 104 each tab has a aperture 106, 107, 108, 109 formed therein. A reinforcing bar 120 having a tab 130, 131 located at each end is provided to reinforce the two box type connectors 29', 30'. The tabs 130, 131 located at the end of reinforcing bar 120 each have an aperture 140, 141 located therein which will cooperate and align with the apertures 106, 107, 108, 109 formed in the tabs 101, 102, 103, 104 of each box type connector 29', 30'. A pin 150, 151 may then be placed in the respective apertures once they are and proper alignment to hold the reinforcing bar 120 in place. Such an arrangement will increase the maximum permissible load that the shoring connection may take before failure.

Figure 6:
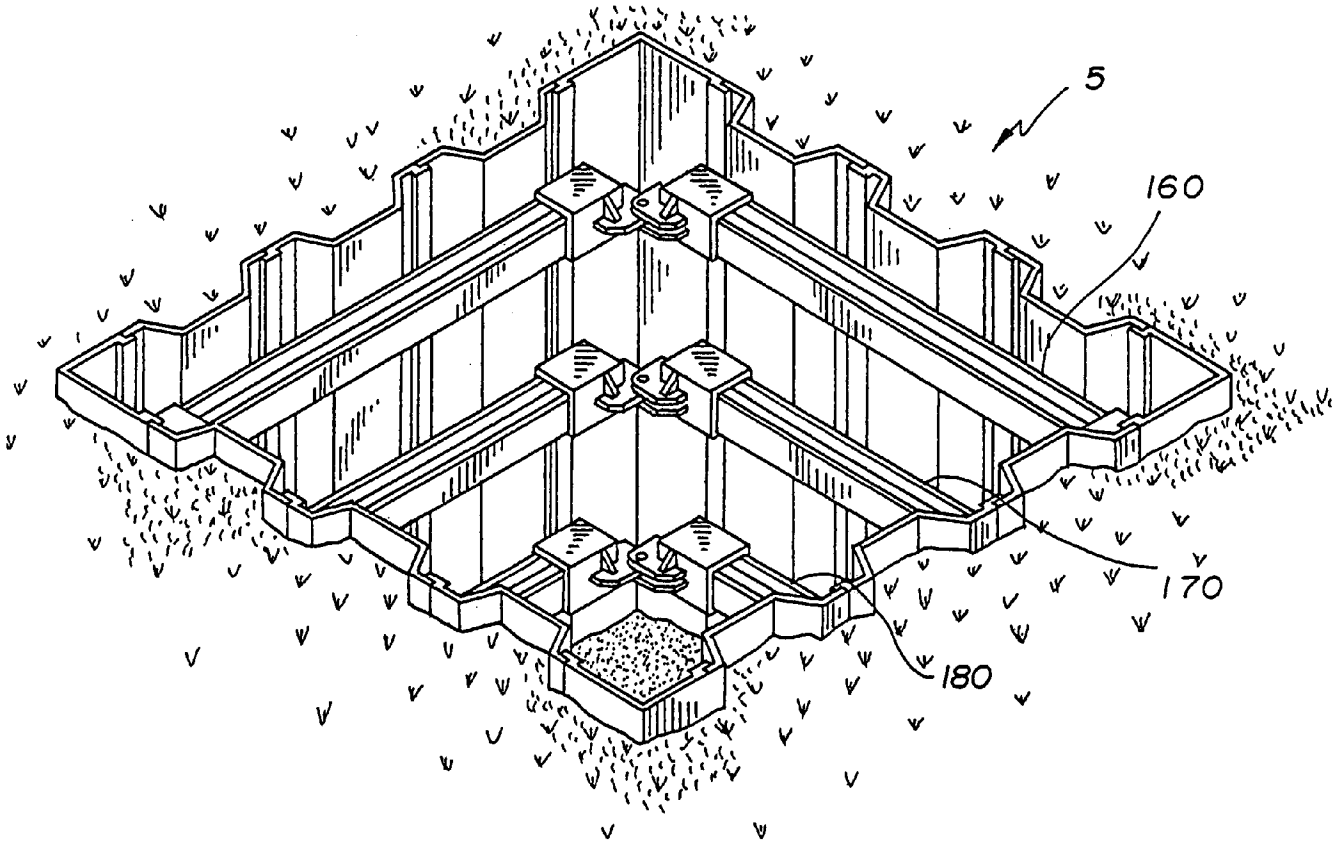
FIG. 6 is a prospective view of a set of three corner connections and associated supporting beams for temporary shoring according to the first preferred embodiment of the invention as it would be seen in use in a typical excavation site.

Alternatively, as shown in FIG. 6, in order to handle larger loads on the shoring, multiple rectangular I beam/box reinforcing structures 160, 170, 180 may be placed in a single excavation site 5. For example the three sets of I-beam/box connectors 160, 170, 180 shown in FIG. 6 can handle a much greater load that a single set is capable of handling. Since the three sets of I-beams and connectors are identical they are relatively cheap to obtain.

In operation, typically the entire shoring assembly would arrive on a truck. Initially the I-beams 20–23 would be arranged in a rectangular or other polygonal shape around the perspective excavation site. Next the connectors 29, 30 such as shown in FIG. 2 are placed on the ends of the I-beams 20–23 forming corner connections 11–14. It is important to note that the connectors may simply be slipped onto the ends of the I-beams 20–23 and that they do not need to be welded thereto. Essentially the main body portion 40 of the connector 29 is adapted to slidably receive the end of an I beam 21 until it hits an abutment such as the end wall 57. Of course, any abutment will do so long as it transfers force from the I-beam 21 to the connector 29. As such, the connections 11–14 and I-beams 20–23 may be easily assembled on site 5. Next the apertures in the tabs of each single and double tab connector are aligned and a pin is placed there through. The reinforcing structure 26 formed of the I-beams 20–23 and corner connections 11–14 now defines the edge of the excavation site 5. The sheet piling 19 is driven into the ground around the reinforcing structure 26. Previously, the sheet piling 19 would have to be driven 2 ft. into the ground for every 1 ft. deep into the ground the excavation site 5 would extend. The cost of using so much sheet piling 19 is extremely expensive. With this new invention the sheet piling 19 need only extend slightly below the bottom of the excavation site 5.

Once a the sheet piling 19 is in place, the dirt and other material within the excavation site's perimeter is then removed. The reinforcing structure 26 is then lowered to an appropriate height. The reinforcing structure 26 is held at that height by chains which extend to the eyelet on each box connector. It should be noted that the reinforcing structure 26 will not actually be under load until and if the sheet piling 19 starts to buckle under the load of dirt or water located behind a sheet piling 19. If the sheet piling 19 starts to buckle the corner connections 11–14 will take that load and be forced tighter unto their respective I-beams 20–23. Once any tolerance between the I-beams 20–23 and corner connections 11–14 is taken up the reinforcing structure 26 will then prevent any further movement of the sheet piling 19 and also prevent a cave in. Workers can then move about the excavation site 5 and safely perform whatever task is necessary. For example, the workers could remove old storage tanks (not shown) which may need removing and replace them with a new set of storage tanks (not shown). Additionally, other structures may be formed within the excavation site 5. For example a of slab of concrete may be poured at the bottom of the excavation site 5 to aid in supporting storage tanks. Additionally, gravel or other fill material may be placed around the tanks as is needed. All the while, the workers will be safe from any potential cave in.

Once the excavation site 5 is ready to be refilled, typically a corner sheet of piling 19 is removed so as to enable the workers to remove the corner connections 11–14. Once one set of corner connectors is removed, the rest of the reinforcing structure 26 can easily be removed the excavation site 5 and used again. One of the great benefits of the instant invention is that the I-beams 20–23 can be rented instead of purchased. This was not possible with prior reinforcing methods because the ends of the I-beam had to be cut to size or a special connector had to be welded there to. Since most rental places require their equipment be returned in substantially the same condition as they were rented the prior art methods could not use rented I-beams. To recognize the cost savings of the subject invention, one must remember that excavation sites are often different sizes. It becomes extremely expensive to have numerous different sized I-beams which have been purchased and must remain in inventory in case an odd size may be needed. With the new invention, a contractor may simply rent the appropriate sized I-beams and return them when the job is done.

Although described with respect to preferred embodiments of the invention, it should be understood that various changes and/or modifications can be made to the invention without departing from the spirit thereof. Therefore, the specific embodiments disclosed herein are to be considered illustrative and not restrictive. Instead, the invention is only intended to be limited by the scope of the following claims.

I claim:

1. A corner connection for connecting shoring beams of a temporary shoring arrangement, said corner connection comprising:

a first shoring beam connector including a hollow main portion formed along a first longitudinal axis and an opening situated at one longitudinal end of said hollow main body portion, wherein said hollow main body portion is adapted to slidably receive, through said opening, a respective end of one of said shoring beams;

a first tab extending laterally from said hollow main body portion and having an aperture located therein adapted to receive a first connecting pin;

a second tab extending laterally away from said hollow main body portion and being spaced longitudinally from said first tab, said second tab having an aperture located therein adapted to receive a second connecting pin;

a second shoring beam connector including a hollow main body portion formed along a second longitudinal axis and an opening situated at one longitudinal end of said hollow main body portion of the second shoring beam connector, wherein the hollow main body portion of the second shoring beam connector is adapted to slidably receive, through said opening of the second shoring beam connector, a respective end of a respective one of said shoring beams;

a first tab extending laterally from said hollow main body portion of the second shoring beam connector and having an aperture located therein adapted to receive the first connecting pin;

a second tab extending laterally from said hollow main body portion of the second shoring beam connector and spaced longitudinally from said first tab of the second shoring beam connector, and having an aperture located therein adapted to receive a connecting pin; and a reinforcing bar having a tab located at each end, each tab of the reinforcing bar having a respective aperture located therein which will cooperate and align with the aperture in the second tab of the first shoring beam connector and the aperture of the second tab of the second shoring beam connector so that pins may be placed in the respective apertures once they are in proper alignment thus holding the reinforcing bar in place.

2. A corner connection according to claim 1 located in a temporary shoring arrangement including upstanding wall portions positioned within an excavation site and braced by a plurality of shoring beams.

3. In a temporary shoring arrangement including upstanding wall portions positioned within an excavation site and braced by a plurality of shoring beams, a corner connection comprising:

a first shoring beam connector including a hollow main portion formed along a first longitudinal axis and an opening situated at one longitudinal end of said hollow main body portion, wherein said hollow main body portion is adapted to slidably receive, through said opening, a respective end of one of said shoring beams;

a first tab extending laterally from said hollow main body portion, and having an aperture located therein adapted to receive a first connecting pin;

a second tab extending laterally away from said hollow main body portion and being spaced longitudinally from said first tab, said second tab having an aperture located therein adapted to receive a second connecting pin;

a second shoring beam connector including a hollow main body portion formed along a second longitudinal axis and an opening situated at one longitudinal end of said hollow main body portion of the second shoring beam connector, wherein the hollow main body portion of the second shoring beam connector is adapted to slidably receive, through said opening of the said shoring beam connector, a respective end of a respective one of said shoring beams;

a first tab extending laterally from said hollow main body portion of the second shoring beam connector, and having an aperture located therein adapted to receive the first connecting pin;

a second tab extending laterally from said hollow main body portion of the second shoring beam connector and spaced longitudinally from said first tab of the second shoring beam connector, and having an aperture located therein adapted to receive a third connecting pin; and a reinforcing bar having a tab located at each end, each reinforcing bar tab having a respective aperture located therein which will cooperate and align with the aperture in the second tab of the first shoring beam connector and the aperture of the second tab of the second shoring beam connector so pins may be placed in the respective apertures once they are in proper alignment thus holding the reinforcing bar in place.

4. In a temporary shoring arrangement including upstanding wall portions positioned within an excavation site and braced by a plurality of shoring beams, a corner connection for connecting shoring beams of the temporary shoring arrangement, said corner connection comprising:

a first shoring beam connector including a hollow main portion formed along a first longitudinal axis and an opening situated at one longitudinal end of said hollow main body portion, wherein said hollow main body portion is adapted to slidably receive, through said opening, a respective end of one of said shoring beams, and a first fastening assembly, the first fastening assembly including a first tab extending laterally from said hollow main body portion and having an aperture located therein adapted to receive a first connecting pin;

a second shoring beam connector including a hollow main body portion formed along a second longitudinal axis and an opening situated at one longitudinal end of said hollow main body portion of the second shoring beam connector, wherein the hollow main body portion of the second shoring beam connector is adapted to slidably receive, through said opening of the second shoring beam connector, a respective end of a respective one of said shoring beams, and a second fastening assembly; and a reinforcing assembly including a reinforcing bar, a first spacer bar attached to the reinforcing bar and the first shoring beam connector and a second spacer bar attached to the reinforcing bar and the second shoring beam connector.

5. A corner connection according to claim 4, wherein said second fastening assembly includes a first tab extending laterally from said hollow main body portion of the second shoring beam connector, and having an aperture located therein adapted to receive a second connecting pin.

6. In a temporary shoring arrangement including upstanding wall portions positioned within an excavation site and braced by a plurality of shoring beams, a corner connection comprising:

a first shoring beam connector including a hollow main portion formed along a first longitudinal axis and an opening situated at one longitudinal end of said hollow main body portion, wherein said hollow main body portion is adapted to slidably receive, through said opening, a respective end of one of said shoring beams, and a first fastening assembly including a first tab extending laterally from said hollow main body portion of the second shoring beam connector, and having an aperture located therein adapted to receive a first connecting pin;

a second shoring beam connector including a hollow main body portion formed along a second longitudinal axis and an opening situated at one longitudinal end of said hollow main body portion of the second shoring beam connector, wherein the hollow main body portion of the second shoring beam connector is adapted to slidably receive, through said opening of the second shoring beam connector, a respective end of a respective one of said shoring beams, and a second fastening assembly; and a reinforcing assembly including a reinforcing bar, a first spacer bar attached to the reinforcing bar and the first shoring beam connector and a second spacer bar attached to the reinforcing bar and the second shoring beam connector.

7. In a temporary shoring arrangement including upstanding wall portions positioned within an excavation site and braced by a plurality of shoring beams, a corner connection comprising:

a first shoring beam connector including a hollow main portion formed along a first longitudinal axis and an opening situated at one longitudinal end of said hollow main body portion, wherein said hollow main body portion is adapted to slidably receive, through said opening, a respective end of one of said shoring beams, and a first fastening assembly;

a second shoring beam connector including a hollow main body portion formed along a second longitudinal axis and an opening situated at one longitudinal end of said hollow main body portion of the second shoring beam connector, wherein the hollow main body portion of the second shoring beam connector is adapted to slidably receive, through said opening of the second shoring beam connector, a respective end of a respective one of said shoring beams, and a second fastening assembly including a first tab extending laterally from said hollow main body portion of the second shoring beam connector, and having aperture located therein adapted to receive a second connecting pin; and a reinforcing assembly including a reinforcing bar, a first spacer bar attached to the reinforcing bar and the first shoring beam connector and a second spacer bar attached to the reinforcing bar and the second shoring beam connector.

* * * * *